US006752464B1

(12) United States Patent
Tseng

(10) Patent No.: US 6,752,464 B1
(45) Date of Patent: Jun. 22, 2004

(54) MODULAR FURNITURE FRAME

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/374,869

(22) Filed: Feb. 26, 2003

(51) Int. Cl.[7] ..... A47C 7/00

(52) U.S. Cl. ..... 297/440.16; 297/411.45; 297/411.35; 297/440.2

(58) Field of Search ..... 297/68, 84, 440.16, 297/83, 440.23, 440.21, 440.2, 440.14

(56) References Cited

U.S. PATENT DOCUMENTS 4,890,888 A * 1/1990 Kostin ..... 297/440.21
5,005,908 A * 4/1991 Young ..... 297/440.21
5,135,284 A * 8/1992 Crum ..... 297/440.15
5,184,871 A 2/1993 LaPointe et al.
5,435,621 A * 7/1995 Komorowski et al. ..... 297/84
5,551,757 A * 9/1996 Glover ..... 297/440.23
5,570,930 A * 11/1996 LaPointe et al. ..... 297/342
5,918,943 A * 7/1999 Mitschelen et al. .... 297/452.18
6,168,236 B1 * 1/2001 Chen ..... 297/411.2
6,241,317 B1 * 6/2001 Wu ..... 297/440.23
6,543,855 B2 * 4/2003 Bruck ..... 297/440.21
6,557,942 B1 * 5/2003 Shieh ..... 297/440.15

* cited by examiner

*Primary Examiner*—Peter M. Cuomo
*Assistant Examiner*—Erika Garrett
(74) *Attorney, Agent, or Firm*—Ladas & Parry

(57) ABSTRACT

A modular furniture frame includes seat and backrest frame units. The seat frame unit includes a pair of upright side frame parts and a pair of rear coupling members, each of which has a base strip mounted on a respective side frame part, and a pair of upright tines that extend integrally from the base strip and that cooperate to form an insert notch. The backrest frame unit includes a backrest member and a pair of engaging members, each of which includes an inner plate mounted on the backrest member and an outer plate mounted on the inner plate and configured to mate with the insert notch in a respective rear coupling member.

7 Claims, 11 Drawing Sheets

MODULAR FURNITURE FRAME

BACKGROUND OF THE INVENTION

1. Field of the Invention

The invention relates to a modular furniture frame, more particularly to a modular furniture frame that is easy to assemble and disassemble so as to facilitate transport of the same.

2. Description of the Related Art

Referring to FIG. 1, a conventional modular sofa is shown to comprise a support base 10, a seat 11 mounted on top of the support base 10, a pair of armrest units 12 mounted on opposite lateral sides of the seat 11, a leg cushion 13 disposed in front of the seat 11, and a backrest 14 disposed behind the seat 11. The seat 11, the armrest units 12 and the backrest 14 are relatively wide and are covered with soft leather so as to provide comfort to users.

Referring to FIG. 2, each of the armrest units 12 includes an upright support member 121 and a horizontal armrest member 122 that are connected integrally to each other. When assembling an armrest unit 12, a pair of fasteners 123 must first pass through the seat 11 before engaging the upright support member 121 so as to secure the armrest unit 12 on the respective lateral side of the seat 11. The armrest member 122 extends horizontally from a top edge of the upright support member 121 so as to provide a comfortable resting place for the user's arm.

The support base 10 includes a parallel pair of upright side frame parts 101, a pair of front coupling members 102 provided respectively on front ends of the side frame parts 101, and a pair of rear coupling members 103 provided respectively on rear ends of the side frame parts 101. Each of the side frame parts 101 has the bottom side of the upright support member 121 of one of the armrest units 12 secured thereon through a pair of vertically extending fasteners 124.

The leg cushion 13 is connected to the front coupling members 102, whereas the backrest 14 is connected to the rear coupling members 103.

Each of the front coupling members 102 has a front end mounted with a vertically extending mounting plate 105. The mounting plate 105 has an L-shaped cross-section, and a front side for mounting the leg cushion 13 thereon.

Each of the rear coupling members 103 is generally triangular in shape, and has a downwardly and forwardly inclining edge that faces toward the leg cushion 13. Each of the rear coupling members 103 is formed with a stop block 104 that projects from an outer side face thereof.

With further reference to FIGS. 3 and 4, the backrest 14 includes a backrest member 15 and a pair of engaging sleeves 16 (only one is visible in the drawings), each of which is mounted fixedly on a respective lateral side of a lower portion of the backrest member 15. Each engaging sleeve 16 includes a sleeve part 161 and a locking member 164.

The sleeve part 161 converges in an upward direction, and includes a base wall 162 and a pair of limiting walls 163 that project respectively from front and rear edges of the base wall 162 and that are bent toward each other. The base wall 162 is secured on the backrest member 15.

The locking member 164 is generally inverted U-shaped, and is mounted on top of the sleeve part 161 prior to mounting the sleeve part 161 on the backrest member 15. The locking member 164 includes a top wall part 165 disposed on top of the sleeve part 161, an inner wall part 166 extending downwardly from an inner edge of the top wall part 165 and to be disposed between the base wall 162 and the backrest member 15, and an outer wall part 167 extending downwardly from an outer edge of the top wall part 165 that is opposite to the inner edge. The outer wall part 167 has a distal end formed with a stop flange 168 that extends toward the base wall 162.

During assembly, the sleeve part 161 of each engaging sleeve 16 is sleeved on the corresponding rear coupling member 103 such that the stop flange 168 abuts against a bottom edge of the stop block 104, thereby locking the engaging sleeve 16 to the corresponding rear coupling member 103. Therefore, to detach the backrest 14 from the support base 10, the stop flanges 168 must be pulled outwardly to disengage from the stop blocks 104, and the backrest 14 must be pulled upwardly at the same time. Since the backrest 14 is rather wide and heavy, and since the engaging sleeves 16 are located at the lower portion of the backrest member 15 and are thus not easy to reach, removal of the backrest 14 cannot be easily conducted by a single person.

Apart from the aforesaid disadvantage, the following are other shortcomings of the conventional modular sofa:

1. the armrest member 122 of each armrest unit 12 extends horizontally from the top edge of the upright support member 121, the width of the modular sofa is increased accordingly, which can hinder passage through narrow alleys, elevator doors, entrances, exits, etc., thereby demanding detachment of the armrest units 12 during transport. Because the upright support members 121 of the armrest units 12 are fastened to the support base 10 by means of the fasteners 124, removal of the armrest units 12 is a rather awkward and time-consuming task.
2. The leg cushion 13 is supported solely by the mounting plates 105 on the front coupling members 102. No support is provided to the central section of the leg cushion 13.

SUMMARY OF THE INVENTION

Therefore, the main object of the present invention is to provide a modular furniture frame having a backrest frame unit that can be easily assembled and disassembled.

Another object of the present invention is to provide a modular furniture frame having armrest frame units that can be easily assembled and disassembled.

Accordingly, a modular furniture frame of this invention comprises a seat frame unit and a backrest frame unit.

The seat frame unit includes a parallel pair of upright side frame parts and a pair of rear coupling members. Each of the side frame parts has front and rear ends opposite to each other in a first direction. The side frame parts are spaced apart from each other in a second direction transverse to the first direction. Each of the rear coupling members has a base strip that extends in the first direction and that is connected to the rear end of a respective one of the side frame parts, and a pair of upright tines that extend integrally from the base strip and that cooperate to form an insert notch having a width which increases in a direction away from the base strip.

The backrest frame unit includes a backrest member having a lower end to be disposed between the rear coupling members, and a pair of engaging members mounted respectively on opposite lateral sides of the lower end of the backrest member. Each of the engaging members includes an inner plate mounted on the respective one of the lateral sides of the backrest member, and an outer plate having an intermediate insert portion mounted on the inner plate. The insert portion is inserted removably into and is configured to mate with the insert notch in an adjacent one of the rear coupling members. The insert portion has front and rear edges opposite to each other in the first direction. The outer plate further has a pair of wing portions that extend respectively in the first direction from the front and rear edges of the insert portion and that cooperate with the inner plate to form a pair of insert grooves. The insert grooves receive removably and respectively the tines of the adjacent one of the rear coupling members.

Preferably, the modular furniture frame further comprises a pair of armrest frame units, each of which includes an upright support member and an armrest member. The upright support member extends in the first direction, is mounted detachably on the seat frame unit, and is disposed at an outer lateral side of a respective one of the side frame parts. The support member has a top side provided with a pair of upright insert tubes. The armrest member is mounted detachably on top of the support member, and has a horizontal section with a bottom side that is provided with a pair of insert posts extended removably and respectively into the insert tubes.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
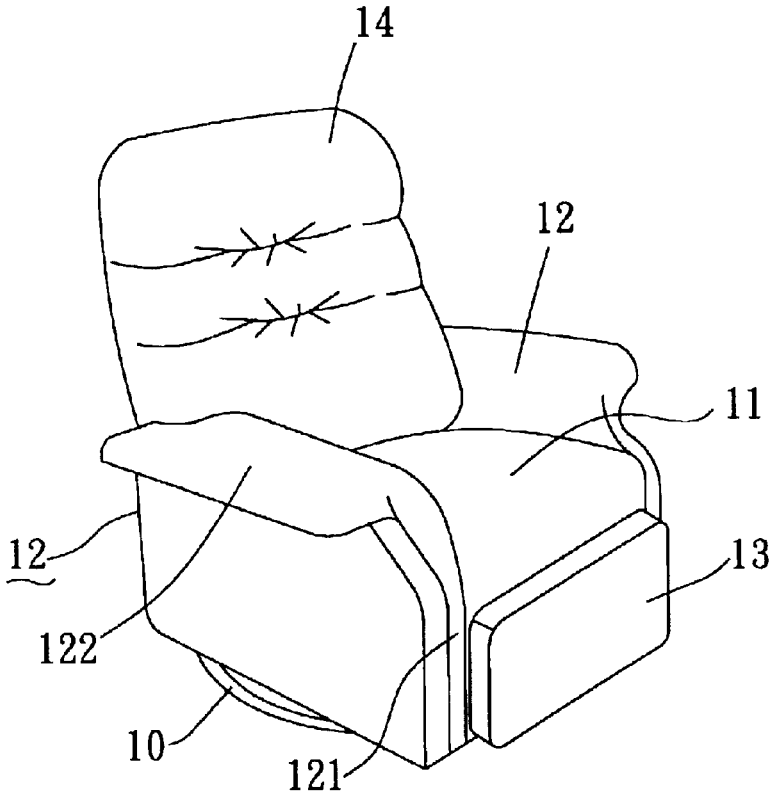
FIG. 1 PRIOR ART
FIG. 1 is an assembled perspective view of a conventional modular sofa.
Figure 2:
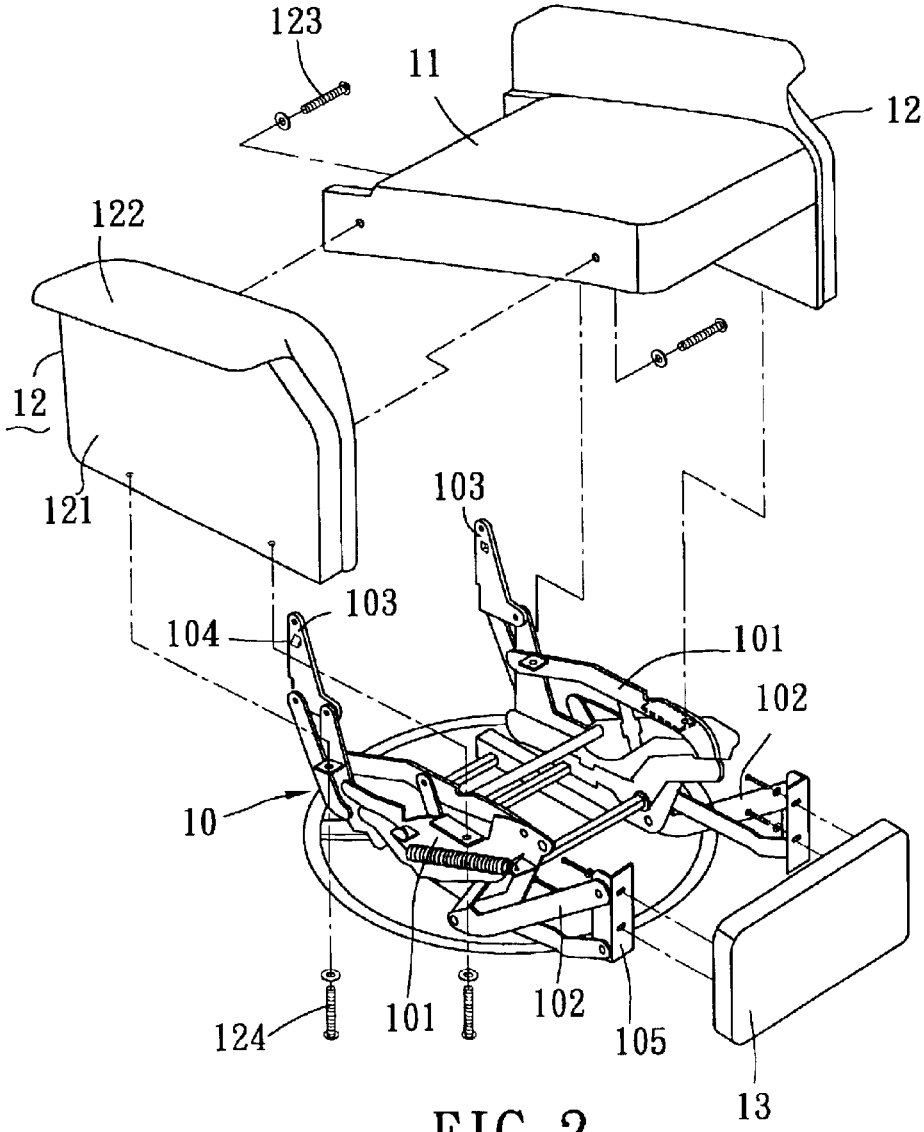
FIG. 2 PRIOR ART
FIG. 2 is a fragmentary, partly exploded, perspective view of the conventional modular sofa.
Figure 3:
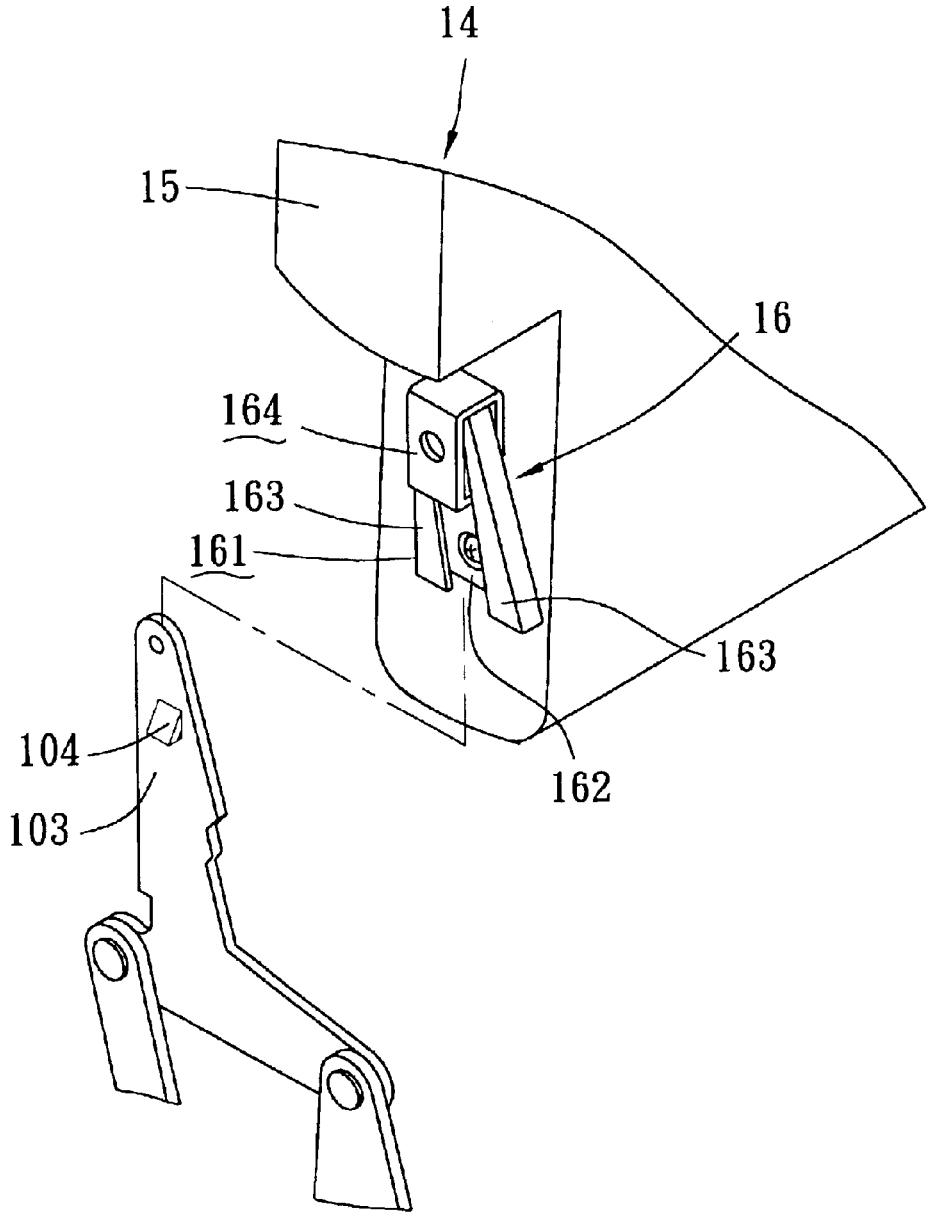
FIG. 3 PRIOR ART
FIG. 3 is a fragmentary exploded perspective view showing a rear coupling member and an engaging sleeve of the conventional modular sofa.
Figure 4:
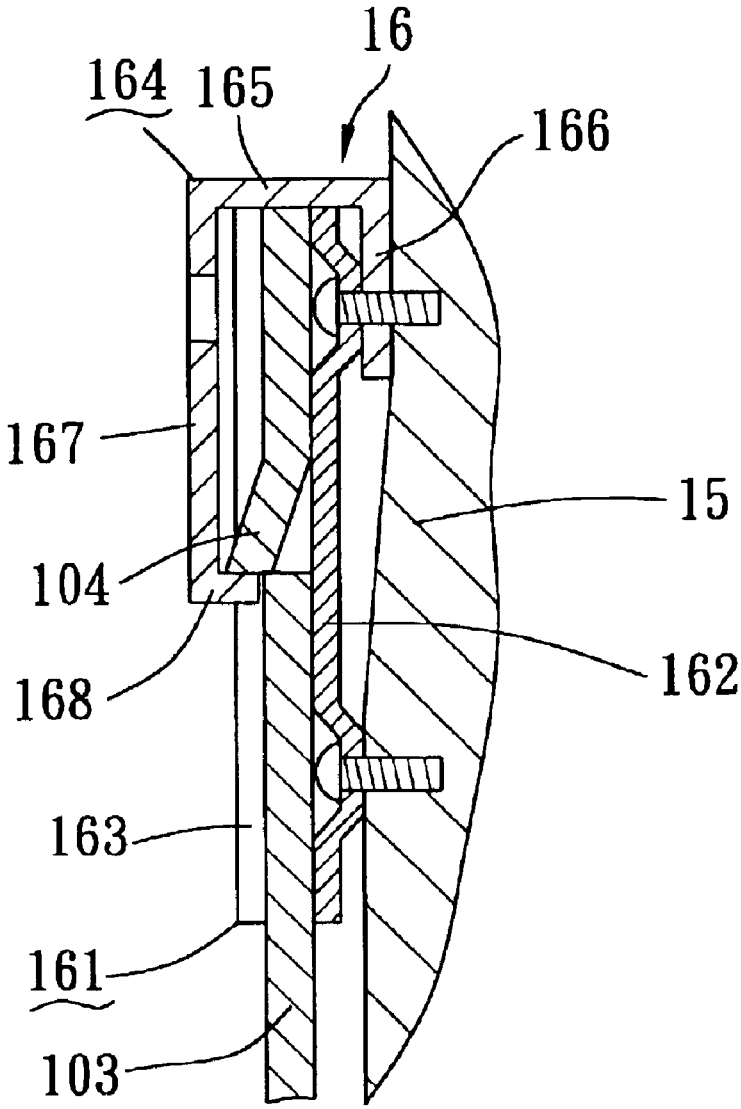
FIG. 4 PRIOR ART
FIG. 4 is a sectional view illustrating locking engagement between the rear coupling member and the engaging sleeve.
Figure 5:
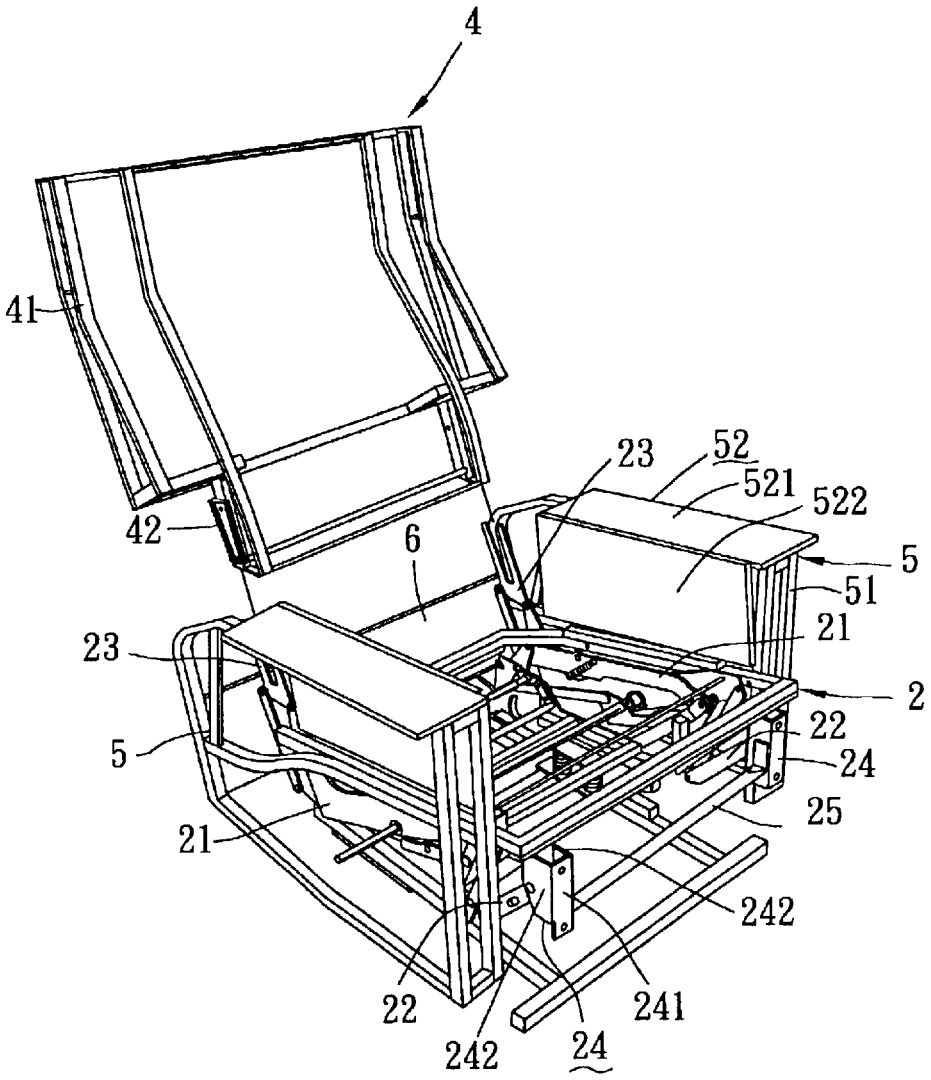
FIG. 5 is a partly exploded perspective view of the preferred embodiment of a modular furniture frame according to the present invention.
Figure 6:
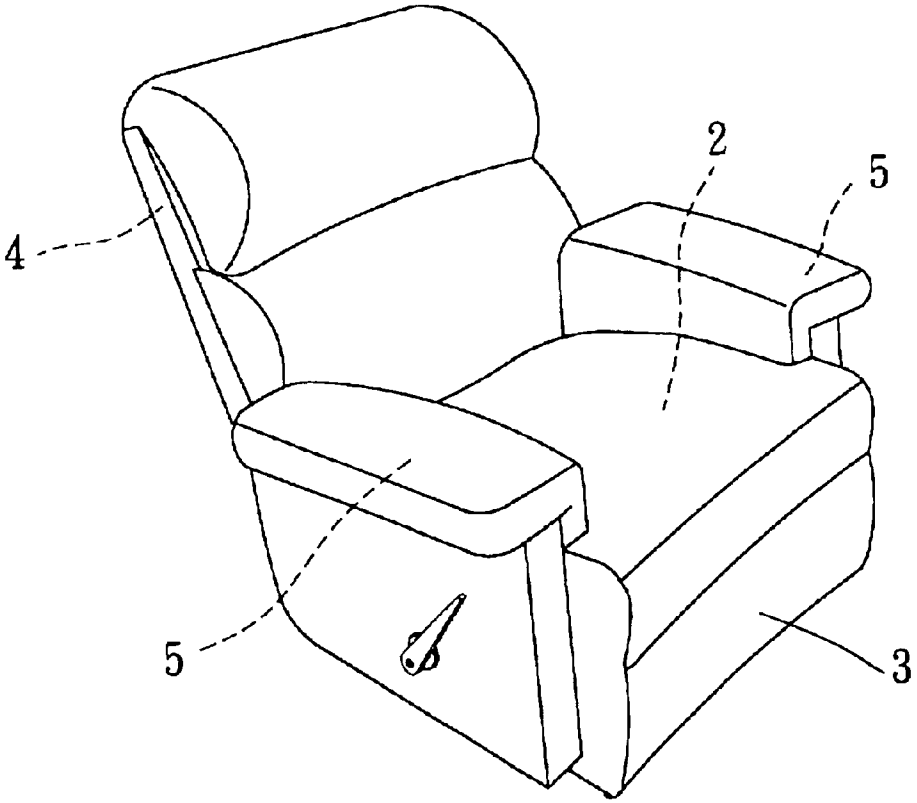
FIG. 6 is a perspective view of the preferred embodiment when upholstered to form a sofa.

Referring to FIG. 5, the preferred embodiment of a modular furniture frame according to the present invention is shown to include a seat frame unit 2, a leg cushion 3 (see FIG. 6) mounted in front of the seat frame unit 2, a backrest frame unit 4 mounted behind the seat frame unit 2, and a pair of armrest frame units 5 mounted on opposite lateral sides of the seat frame unit 2. In actual use, the seat frame unit 2, the backrest frame unit 4 and the armrest frame units 5 are upholstered to form a sofa, as best shown in FIG. 6.

The seat frame unit 2 includes a parallel pair of upright side frame parts 21, each of which has front and rear ends opposite to each other in a first direction. The side frame parts 21 are spaced apart from each other in a second direction transverse to the first direction. The seat frame unit 2 further includes a pair of rear coupling members 23 that are connected to the rear ends of the side frame parts 21, a pair of front coupling members 22 that are mounted on the front ends of the side frame parts 21, a pair of mounting members 24 that are mounted on the front coupling members 22, and a bracing rod 25. The rear coupling members 23 are used to mount the backrest frame unit 4 on the seat frame unit 2, whereas the mounting members 24 on the front coupling members 22 are used to mount the leg cushion 3 on the seat frame unit 2.

Each mounting member 24 has a generally U-shaped cross section, and includes an intermediate plate 241 and a pair of end strips 242 that extend rearwardly from opposite lateral edges of the intermediate plate 241 and that are mounted on the respective front coupling member 22. The leg cushion 3 is mounted securely on the intermediate plates 241 of the mounting members 24. The bracing rod 25 extends in the second direction, and has opposite ends connected fixedly and respectively to the mounting members 24 at the end strips 242 of the latter. The bracing rod 25 is disposed to abut against a rear side of the leg cushion 3 for providing additional support thereto.

Figure 7:
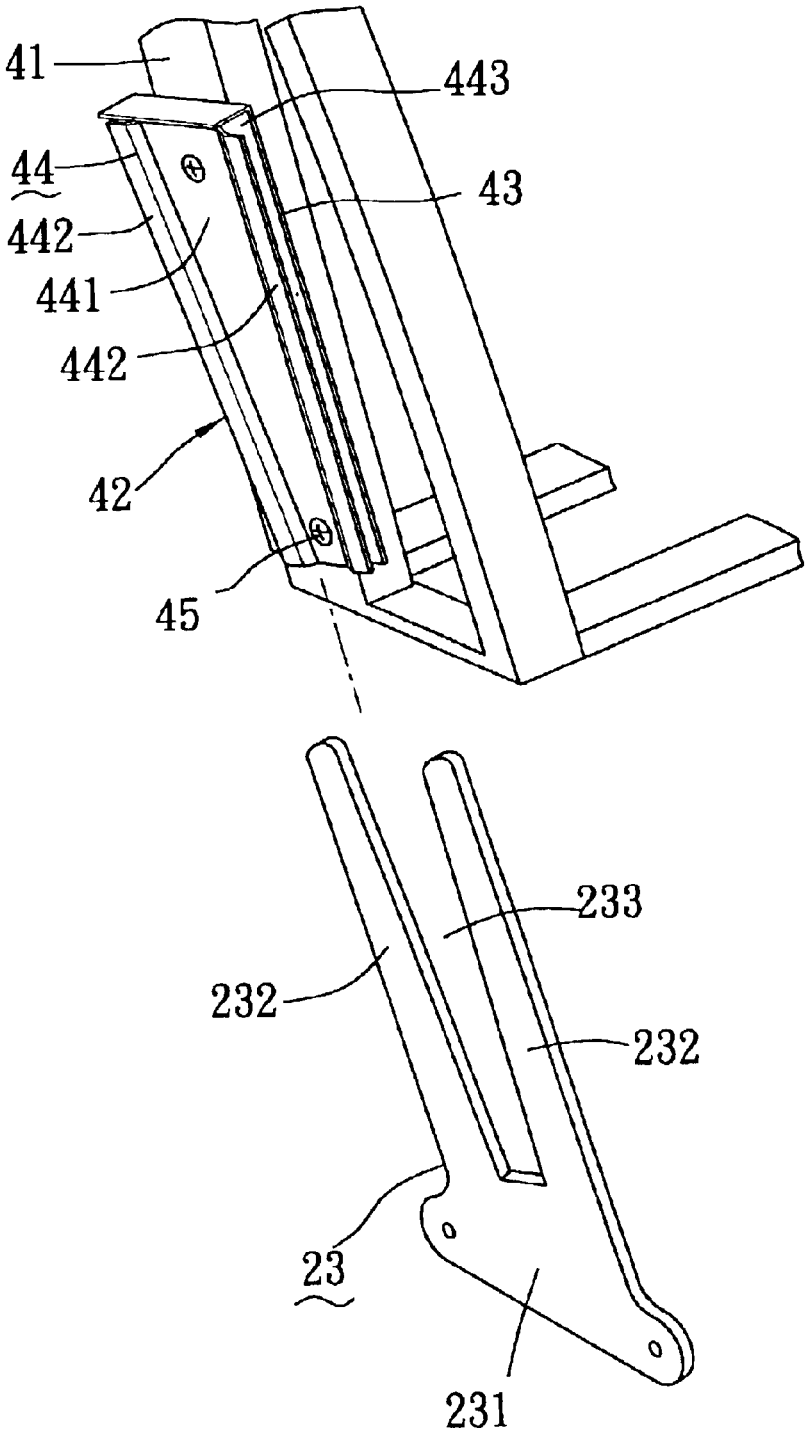
FIG. 7 is an exploded perspective view showing an engaging member and a rear coupling member of the preferred embodiment.

With further reference to FIG. 7, each rear coupling member 23 has a base strip 231 that extends in the first direction and that is connected to the rear end of a respective one of the side frame parts 21, and a pair of upright tines 232 that extend integrally and inclinedly from the base strip 231 and that cooperate to form an insert notch 233 having a width which increases in a direction away from the base strip 231.

The backrest frame unit 4 includes a generally rectangular backrest member 41 having a lower end to be disposed between the rear coupling members 23 of the seat frame unit 2, and a pair of engaging members 42 mounted fixedly and respectively on opposite lateral sides of the lower end of the backrest member 41 by means of fasteners 45.

Figure 8:
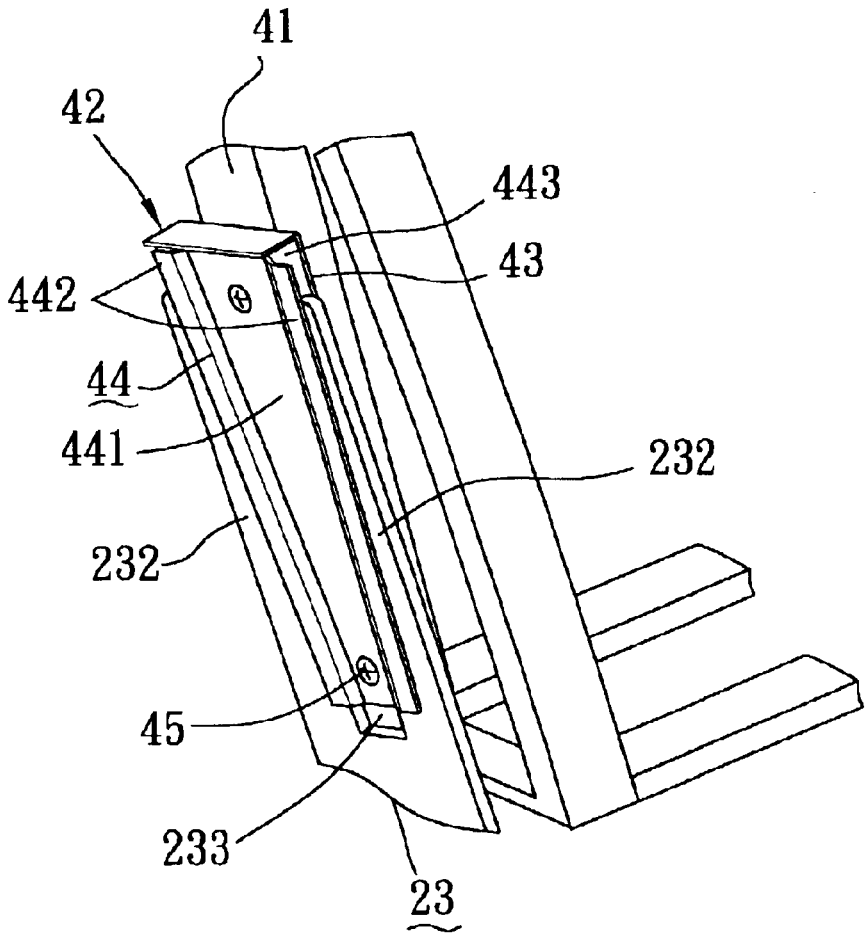
FIG. 8 is a perspective view to illustrate engagement between the engaging member and the rear coupling member.
Figure 9:
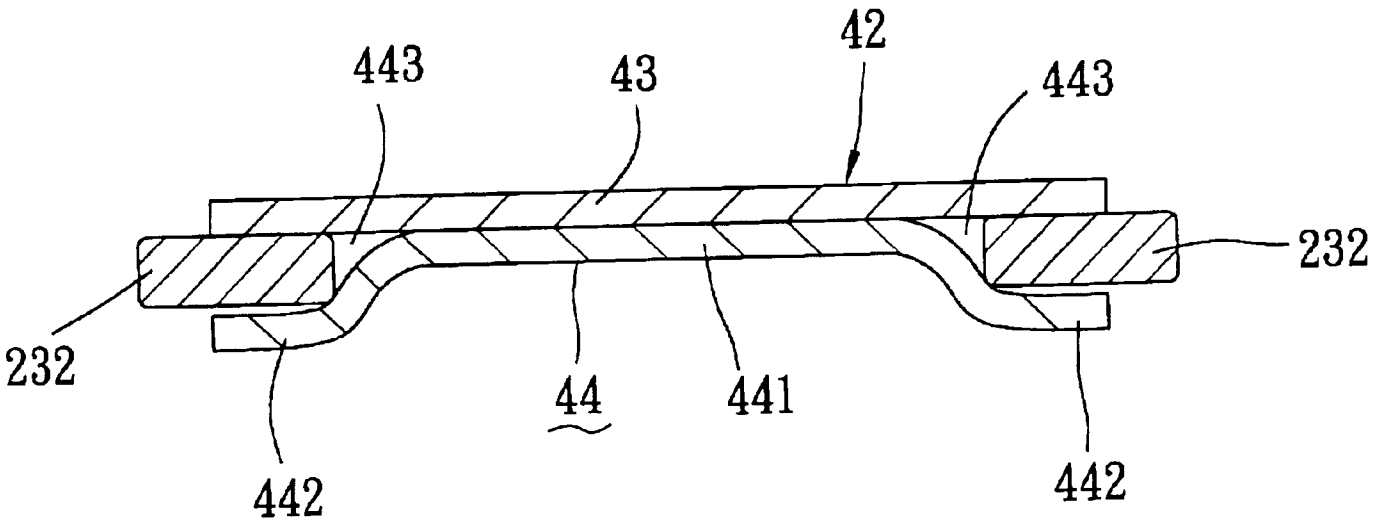
FIG. 9 is a sectional view of FIG. 8.

As shown in FIGS. 7, 8 and 9, each of the engaging members 42 includes an inner plate 43 mounted on the respective one of the lateral sides of the backrest member 41, and an outer plate 44. The outer plate 44 has an intermediate insert portion 441 mounted on the inner plate 43. The insert portion 441 is inserted removably into and is configured to mate with the insert notch 233 in an adjacent one of the rear coupling members 23. The insert portion 441 has front and rear edges opposite to each other in the first direction. The outer plate 44 further has a pair of wing portions 442 that extend respectively in the first direction from the front and rear edges of the insert portion 441 and that cooperate with the inner plate 43 to form a pair of insert grooves 443. The insert grooves 443 receive removably and respectively the tines 232 of the adjacent one of the rear coupling members 23.

When mounting the backrest frame unit 4 on the seat frame unit 2, the engaging members 42 are moved downwardly toward the rear coupling members 23 to insert the insert portions 441 into the insert notches 233 and to dispose the tines 232 in the insert grooves 443. Due to the engagement between the insert portions 441 and the insert notches 233, which have varying widths, and the engagement between the tines 232 and the insert grooves 233, firm connection between the backrest frame unit 4 and the seat frame unit 2 can be ensured.

Accordingly, when detaching the backrest frame unit 4, it is only required to lift the backrest member 41 so as to disengage the engaging members 42 from the rear coupling members 23. The detaching operation is thus relatively easy to conduct.

Figure 10:
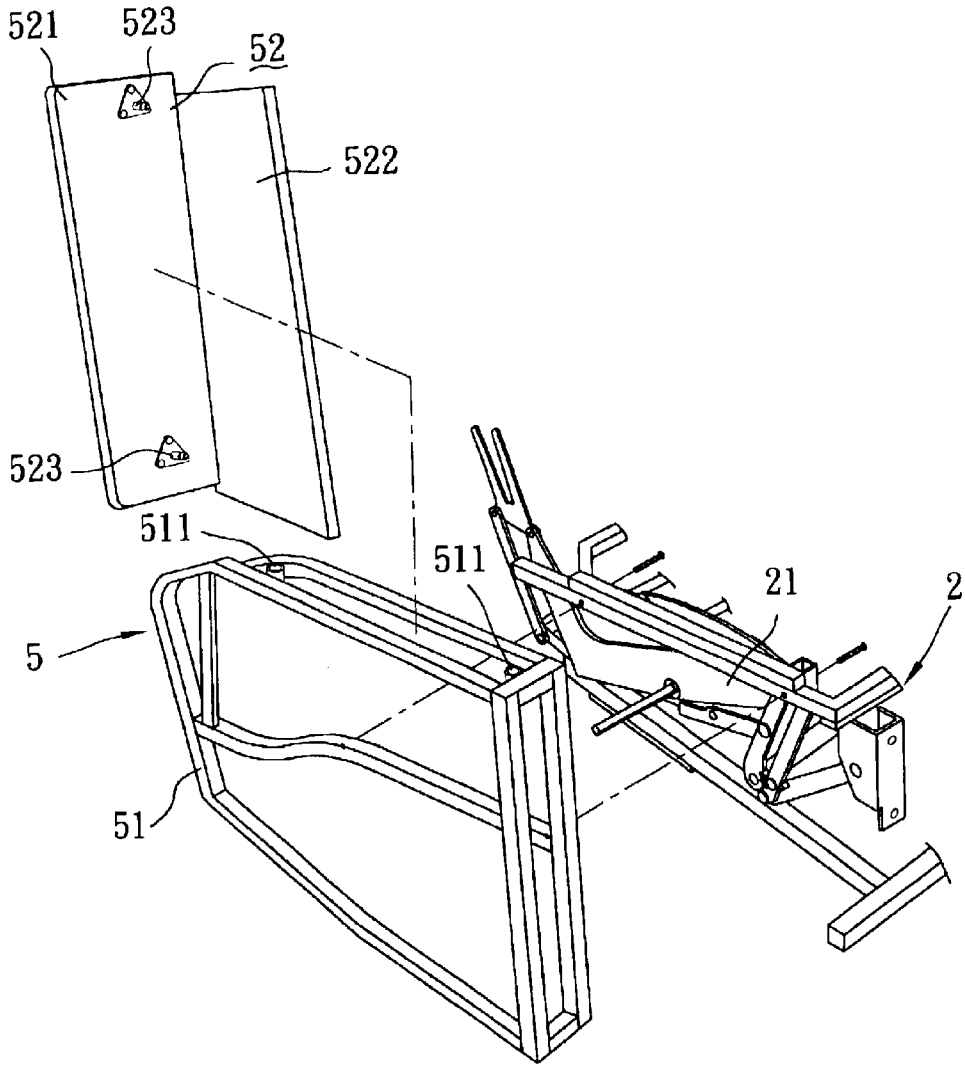
FIG. 10 is an exploded perspective view showing an armrest frame unit and a side frame part of a seat frame unit of the preferred embodiment.
Figure 11:
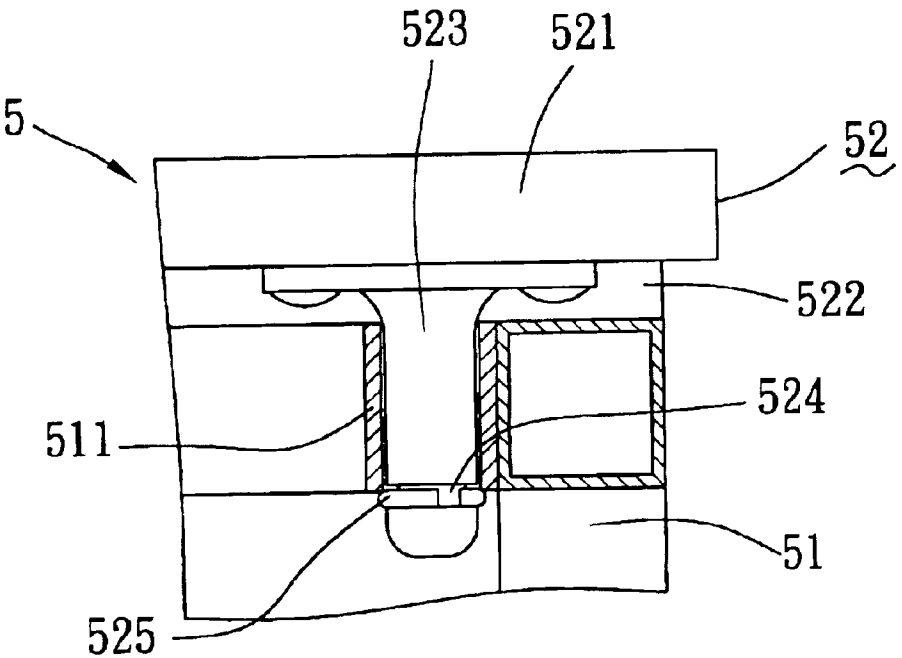
FIG. 11 is a sectional view to illustrate engagement between an armrest member and an upright support member of an armrest frame unit of the preferred embodiment.

As shown in FIGS. 5, 10 and 11, each of the armrest frame units 5 is disposed at an outer lateral side of a respective one of the side frame parts 21, and includes an upright support member 51 that extends in the first direction and that is mounted detachably on the seat frame unit 2, and an armrest member 52 that is mounted detachably on top of the support member 51. The upright support member 51 has a top side provided with a pair of upright insert tubes 511 spaced apart from each other in the first direction. The armrest member 52 is generally L-shaped, and has a horizontal section 521 with a bottom side that is provided with a pair of insert posts 523 extended removably and respectively into the insert tubes 511, and a vertical section 522 that extends from the horizontal section 521 and that is disposed to abut against an inner lateral side of the support member 51.

In the preferred embodiment, each of the insert posts 523 is longer than the respective one of the insert tubes 511 such that a lower portion of each of the insert posts 523 extends downwardly through the respective one of the insert tubes 511. The lower portion of each of the insert posts 523 is formed with a peripheral groove 524. A resilient C-shaped ring 525 is received in the peripheral groove 524, and has a diameter slightly larger than the insert post 523 when in an uncompressed state. Accordingly, the C-shaped ring 525 engages the respective one of the insert tubes 511 to restrain unforced uprooting movement of the insert post 523 relative to the respective one of the insert tubes 511, and is compressible for squeezing into the peripheral groove 524 during insertion and removal of the insert post 523 into and from the respective one of the insert tubes 511.

The presence of the insert posts 523, the insert tubes 511, the resilient C-shaped rings 525 and the peripheral grooves 524 permits easy assembly of the armrest member 52 on the upright support member 51, provides sufficient resistance to arrest unforced upward movement of the armrest member 52 away from the upright support member 51, and at the same time, offers convenience when detaching the armrest member 52 from the upright support member 51 to facilitate transport of the preferred embodiment through narrow passages.

Referring again to FIG. 6, the modular furniture frame further comprises a connecting plate 6 that extends in the second direction and that has opposite ends connected respectively to rear ends of the support members 51 of the armrest frame units 5 so as to enhance stability.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A modular furniture frame comprising:

a seat frame unit including a parallel pair of upright side frame parts, each of which has front and rear ends opposite to each other in a first direction, said side frame parts being spaced apart from each other in a second direction transverse to the first direction, and a pair of rear coupling members, each of which has a base strip that extends in the first direction and that is connected to said rear end of a respective one of said side frame parts, and a pair of upright tines that extend integrally from said base strip and that cooperate to form an insert notch having a width which increases in a direction away from said base strip; and a backrest frame unit including a backrest member having a lower end to be disposed between said rear coupling members, and a pair of engaging members mounted respectively on opposite lateral sides of said lower end of said backrest member, each of said engaging members including an inner plate mounted on the respective one of said lateral sides of said backrest member, and an outer plate having an intermediate insert portion mounted on said inner plate, said insert portion being inserted removably into and being configured to mate with said insert notch in an adjacent one of said rear coupling members, said insert portion having front and rear edges opposite to each other in the first direction, said outer plate further having a pair of wing portions that extend respectively in the first direction from said front and rear edges of said insert portion and that cooperate with said inner plate to form a pair of insert grooves, said insert grooves receiving removably and respectively said tines of the adjacent one of said rear coupling members.

2. The modular furniture frame of claim 1, further comprising a pair of armrest frame units, each of which includes an upright support member that extends in the first direction, that is mounted detachably on said seat frame unit, and that is disposed at an outer lateral side of a respective one of said side frame parts, said support member having a top side provided with a pair of upright insert tubes, and an armrest member mounted detachably on top of said support member and having a horizontal section with a bottom side that is provided with a pair of insert posts extended removably and respectively into said insert tubes.

3. The modular furniture frame of claim 2, wherein each of said insert posts is longer than the respective one of said insert tubes such that a lower portion of each of said insert posts extends downwardly through the respective one of said insert tubes, said lower portion of each of said insert posts being formed with a peripheral groove, each of said insert posts further having a resilient C-shaped ring received in said peripheral groove, said C-shaped ring engaging the respective one of said insert tubes to restrain unforced uprooting movement of said insert post relative to the respective one of said insert tubes and being compressible for squeezing into said peripheral groove during insertion and removal of said insert post into and from the respective one of said insert tubes.

4. The modular furniture frame of claim 2, wherein said armrest member further has a vertical section that extends from said horizontal section and that is disposed to abut against an inner lateral side of said support member.

5. The modular furniture frame of claim 2, further comprising a connecting plate that extends in the second direction and that has opposite ends connected respectively to rear ends of said support members of said armrest frame units.

6. The modular furniture frame of claim 1, wherein said seat frame unit further includes a pair of front coupling members mounted respectively on said front ends of said side frame parts, said modular furniture frame further comprising a leg cushion disposed in front of said seat frame unit and mounted on said front coupling members.

7. The modular furniture frame of claim 6, wherein said seat frame unit further includes a bracing rod that extends in the second direction and that has opposite ends connected to said front coupling members, respectively, said bracing rod being disposed to abut against a rear side of said leg cushion.

* * * * *